US005667113A

United States Patent [19]

Clarke et al.

[11] Patent Number: 5,667,113

[45] Date of Patent: Sep. 16, 1997

[54] WHEELED FUEL CONTAINER

[75] Inventors: John F. Clarke, Akron; Ronald R. Eureka, Mantua, both of Ohio

[73] Assignee: Tempo Products Company, Cleveland, Ohio

[21] Appl. No.: 607,803

[22] Filed: Feb. 27, 1996

Related U.S. Application Data

[63] Continuation of Ser. No. 376,824, Jan. 23, 1995, abandoned.

[51] Int. Cl.[6] ..... B67D 5/37

[52] U.S. Cl. ..... 222/608; 222/482; 222/529; 222/530

[58] Field of Search ..... 222/529, 530, 222/608, 610, 383.1, 482, 331; 220/4.12–4.14, 669, 675; 280/47.26, 47.33

[56] References Cited

U.S. PATENT DOCUMENTS

| | | | |
|---|---|---|---|
| 1,711,134 | 4/1929 | Brand | 222/331 |
| 2,384,174 | 9/1945 | Jones . | |
| 2,777,610 | 1/1957 | Fox et al. | 222/530 |
| 3,366,397 | 1/1968 | Zeilstra et al. | 280/47.26 |
| 3,865,270 | 2/1975 | Peterson . | |
| 4,231,482 | 11/1980 | Bogan | 220/675 |
| 4,607,857 | 8/1986 | LeSage et al. . | |
| 4,609,106 | 9/1986 | Gentili | 220/675 |
| 4,635,950 | 1/1987 | LeSage et al. . | |
| 4,778,191 | 10/1988 | Heisson . | |
| 4,877,261 | 10/1989 | Heisson . | |
| 4,972,972 | 11/1990 | Goguen | 222/530 |
| 5,069,385 | 12/1991 | Farber . | |
| 5,139,278 | 8/1992 | Vlasicak . | |
| 5,154,317 | 10/1992 | Roppolo, III | 222/608 |
| 5,472,124 | 12/1995 | Martushev | 222/530 |
| 5,494,191 | 2/1996 | Benson | 222/608 |

FOREIGN PATENT DOCUMENTS

| | | |
|---|---|---|
| 1.016.999 | 11/1952 | France . |
| 577378 | 5/1958 | Italy . |

OTHER PUBLICATIONS

Tempo Marine Products 1995 catalog cover page and pp. 1–5,9,19 and reference chart.

Tempo Products Company brochure entitled "Portable Fuel/Solvent Systems".

AW Direct Contractor & Utility Truck Accessories Magazine p. 31, GS–10 fuel transfer tank.

Goodall Mfg. Co. Oct. 1994 Catalog cover page and pp. 32 and 33.

*Primary Examiner*—Philippe Derakshani

*Attorney, Agent, or Firm*—Fay, Sharpe, Beall, Fagan, Minnich & McKee

[57] ABSTRACT

A wheeled fuel tank includes an elongated container having a hollow interior enclosed by a bottom wall, two side walls, a front wall, a back wall and a top wall. A fill spout is disposed on the container for filling the container with a fuel. A first opening is located in the container for allowing an outflow of the fuel. A reinforcing chamber extends through the container from the front wall to the back wall for restricting an expansion of the container and increasing its strength. An axle is rotatably mounted on the back wall of the container and a respective one of a pair of wheels is mounted on a respective end of the axle for enabling the container to be wheeled to a desired location. Preferably the container also includes a handle which is integrally mounted thereon. The handle can include first and second rearwardly extending ears, which are defined by the rear wall and a respective one of the side walls of the container, and a crossbar extending between the ears and being of one piece therewith. Preferably the container is manufactured from a plastic material and is of one piece.

30 Claims, 9 Drawing Sheets

WHEELED FUEL CONTAINER

This application is a continuation of application, Ser. No. 08/376,824 filed on Jan. 23, 1995 now abandoned.

BACKGROUND OF THE INVENTION

This invention relates generally to wheeled containers. More particularly, it relates to a fuel container for refueling a variety of vehicles.

The invention is particularly applicable to a wheeled fuel container for the marine industry. However, it will be appreciated by those skilled in the art that the invention has broader applications and may also be adapted for use in many other environments in which a wheeled fluid container, whether for fuel or other liquids, may be useful.

Boats usually have sizeable fuel tanks because they consume large quantities of fuel in comparison to, e.g., cars, trucks and the like. For wheeled vehicles, it is common to provide one and two gallon auxiliary fuel containers. For marine vehicles, it has become common to provide six or twelve gallon auxiliary fuel containers. However, even these containers are not large enough to refuel a fuel tank of a recreational or pleasure boat, much less the fuel tank of a commercial boat.

One known larger size auxiliary fuel container is a twenty-five gallon rectangular plastic container which is mounted on wheels. This container is claimed to be useable in either an upright position or a reclining position without spilling its contents. One difficulty with fuel containers of this size, however, is that during the summer, heat will vaporize some of the fuel held therein and vapor pressure will build up in the container. Plastic fuel containers have a tendency to expand beyond the 5% air expansion space commonly provided. If the known fuel tank is filled to its rated capacity with fuel and is exposed to the hot summer sun, it may become distorted due to fuel vapor pressure. In addition, this known fuel tank has wheels which extend laterally past the sidewalls of the tank. Such wheels become obstructions to movement and have the potential for scratching or marring either the boat next to which the tank is wheeled or items on the dock. The known tank also does not have the capability of fueling a boat or another vehicle by other than a gravity feed. In addition, the gravity feed spout of the known fuel tank is not recessed and there is thus the possibility that the spout may be sheared off during transport of the tank.

Accordingly, it has been considered desirable to develop a new and improved wheeled fuel container which would overcome the foregoing difficulties and others while providing better and more advantageous overall results.

BRIEF SUMMARY OF THE INVENTION

In accordance with the present invention, a new and improved wheeled fuel tank is provided.

More particularly in accordance with this aspect of the invention, the wheeled fuel tank comprises a container having a hollow interior enclosed by a bottom wall, two side walls, a front wall, a back wall and a top wall. A fill spout is disposed on the container for filling the container with a fuel. A first opening in the container allows an outflow of the fuel. A reinforcing chamber extends through the container from the front wall to the back wall for restricting an expansion of the container due to fuel vapor pressure and increasing its strength. An axle is rotatably mounted on the back wall and a pair of wheels is provided, a respective one being mounted on a respective end of the axle for enabling the container to be wheeled to a desired location.

Preferably, the fuel tank further comprises a handle which is integrally mounted on the container with the handle comprising first and second rearwardly extending ears defined by the rear wall and a respective side wall of the container and a crossbar extending between the ears and being of one piece therewith. Preferably the side and back walls define a pair of recesses, each recess accommodating a respective one of the wheels thereby enabling the container to be no wider at the wheels than at the remainder of the container. Preferably the fuel tank further comprises at least one recessed strip portion extending transversely across the front wall and at least a portion of the side walls, the at least one recessed strip strengthening the container and providing a positioning means for associated hold-down straps for the container.

Preferably the container further comprises a second opening for allowing an outflow of the fuel, with the second opening being spaced from the first opening. A pump is selectively securable in the second opening. Preferably a valve is secured to a stem defining the first opening in the container with a hose being secured at one end to the valve and a nozzle being secured to another end of the hose. The fill spout can, if desired, be located on an intermediate wall defined between the front wall and the top wall and the tank can further comprise a fill cap closing the fill spout. If desired, a plurality of indented sections can be defined on at least one of the walls of the container for strengthening the container.

One advantage of the present invention is the provision of a new and improved fuel container.

Another advantage of the present invention is the provision of a large size plastic fuel container which is less prone to distortion due to vapor pressure which builds up in fuel held in a tank that is exposed to the sun, especially during the summer.

Still another advantage of the present invention is the provision of a wheeled fuel container in which the wheels are located in recesses on the sides of the container so as to reduce the possibility that the wheels will obstruct the movement of the container or scratch or mar adjacent objects.

Yet another advantage of the present invention is the provision of a wheeled fuel container having an integral handle with the handle and wheels being so located on the container that the container can sit in a stable upright position or lie in a stable horizontal position.

A further advantage of the present invention is the provision of a high strength fuel container which meets United States Department of Transportation requirements for transporting gasoline and also meets current marine standards set by the Coast Guard and by the American Boat and Yacht Club.

A still further advantage of the present invention is the provision of a fuel container having a pair of rear rails which enable the container to more easily slide when in a horizontal position, such as in the bed of a pickup truck, especially when the container is full.

A yet further advantage of the present invention is the provision of a fuel container having a first outlet for gravity filling vehicle tanks when the container is in an upright position and also having a top bung in which a rotary hand pump can be selectively mounted to allow a transfer of fuel from the container to an elevated fuel tank.

An additional advantage of the present invention is the provision of a fuel container having a gravity feed spout located in a recessed area. A valve is mounted on the spout to regulate the flow of fuel. Because the weakest point on the container is the joint between the valve and the spout, the recessing of this area of the fuel tank offers protection to the joint thereby reducing the possibility that this joint will be damaged during tranport of the container.

Still further advantages of the present invention will become apparent to those of ordinary skill in the art upon a reading and understanding of the following detailed description of the preferred embodiments.

BRIEF DESCRIPTION OF THE DRAWINGS

The invention may take form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
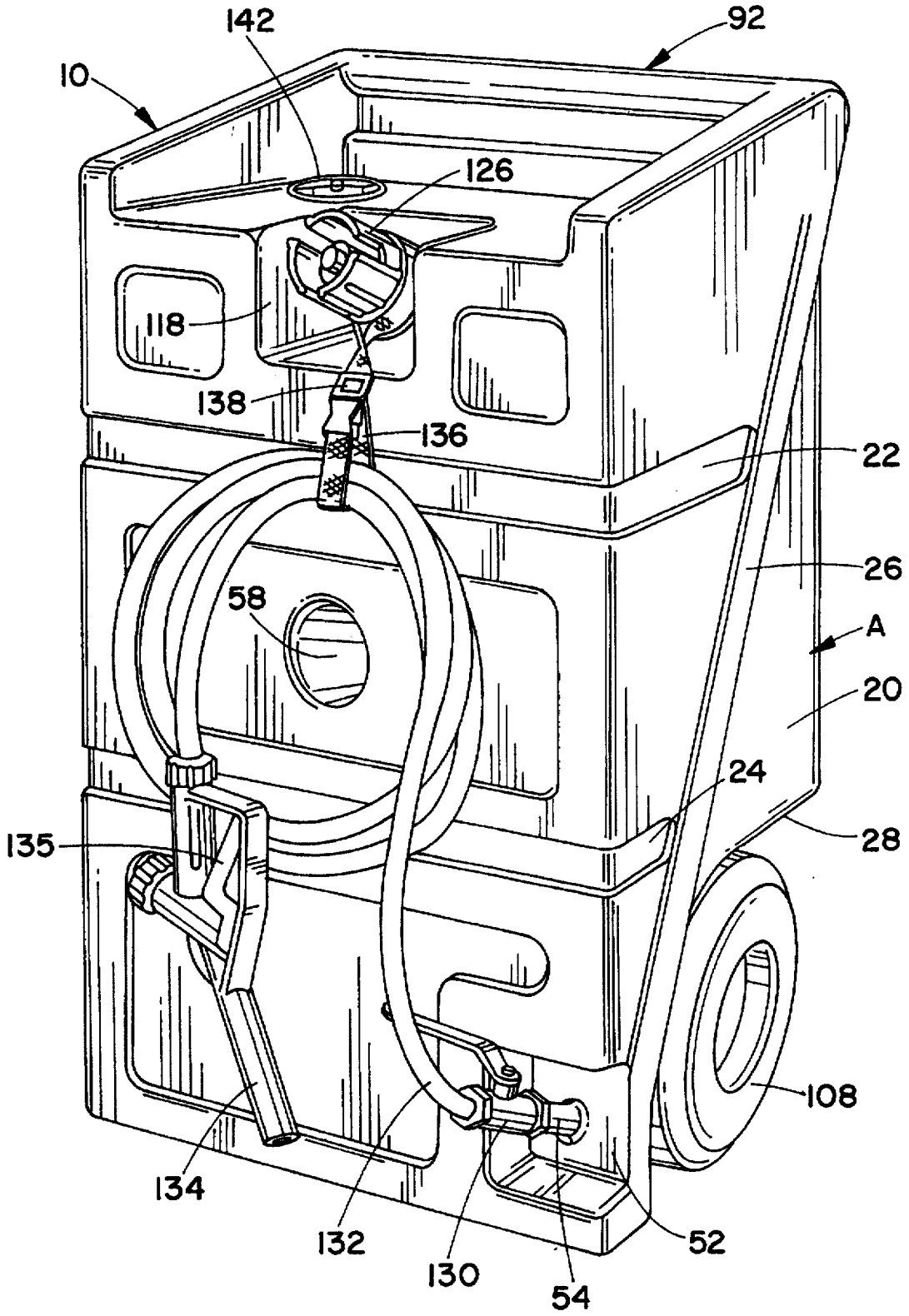
FIG. 1 is a perspective view of a wheeled fuel tank according to a first preferred embodiment of the present invention.

Referring now to the drawings wherein the showings are for purposes of illustrating a preferred embodiment of the invention only and not for purposes of limiting same, FIG. 1 shows the subject new wheeled fuel tank A. While the tank is primarily designed for, and will be hereinafter be described in connection with the refueling of marine vehicles, it will be appreciated that the tank could also be used in various other refueling environments. In addition, the tank could be used for transporting liquids in a variety of other environments.

Figure 4:
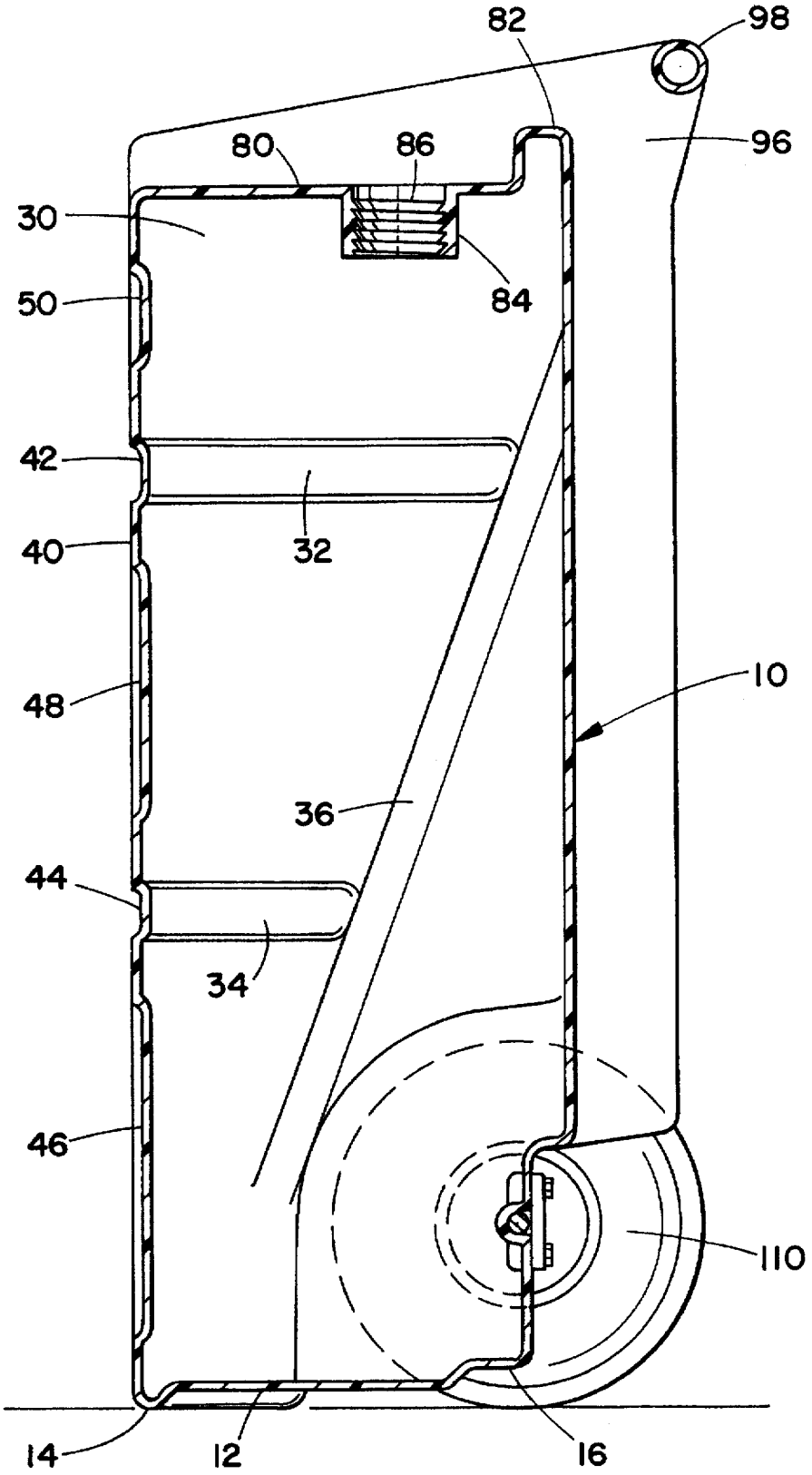
FIG. 4 is a cross-sectional view of the tank of FIG. 2 along line 4—4.

The fuel tank A comprises a container 10 which is substantially rectangular in appearance, i.e. is a parallelepiped. As shown in FIG. 4, the container includes a bottom wall 12 having a somewhat U-shaped rib 14 that extends downwardly from the bottom wall at the front edge thereof and at the forward portion of the two side edges. The bottom wall also includes a recessed section 16 at the rear end thereof. The rib and recessed section serve to strengthen the bottom wall.

As best shown perhaps in FIG. 1, the container also includes a first side wall 20 having a first recessed strip 22 extending transversely across it and spaced therefrom, a second recessed strip 24. The side wall further includes a raised strip 26 which extends diagonally along a substantial portion of the length of the side wall. The first side wall 20 also includes a recessed area 28 adjacent its lower end.

With reference again to FIG. 4, a second side wall 30 of the container includes a first recessed strip 32 extending transversely across it and spaced therefrom a second recessed strip 34, as well as a diagonally extending raised strip 36. The second side wall 30 also includes a recessed area 38 (FIG. 6) adjacent its lower end.

Figure 2:
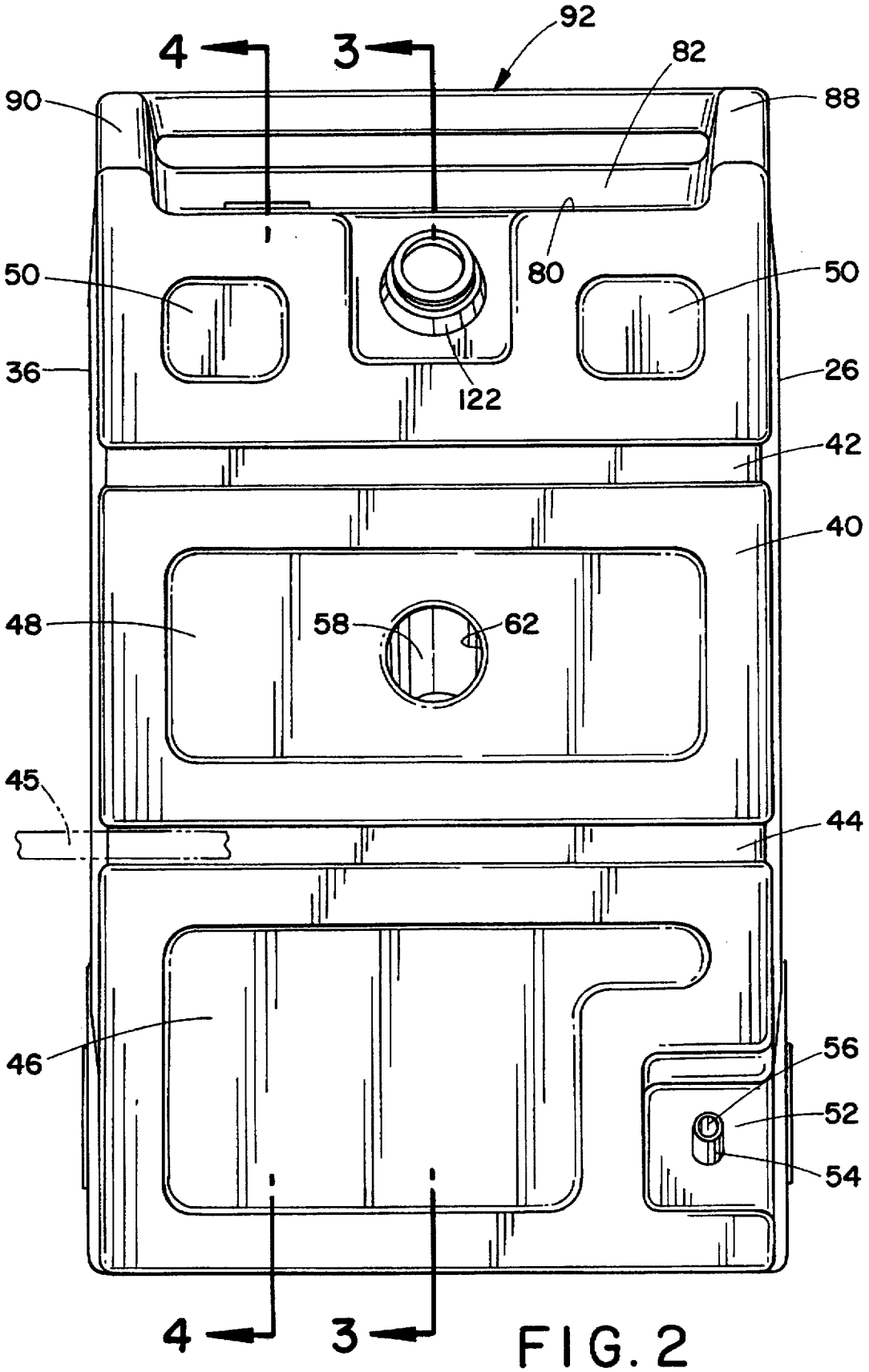
FIG. 2 is a front elevational view of the tank of FIG. 1 with certain components removed for ease of comprehension.

With reference now to FIG. 2, a front wall 40 of the container includes spaced first and second recessed strips 42 and 44 extending transversely across it. These strips are aligned with and communicate with the first and second recessed strips 22, 32 and 24, 34 on the two side walls 20 and 30 of the container. These strips together cooperate to provide a positioning means for an associated hold-down strap 45 for the container as is conventional in the art. In addition, the recessed strips strengthen the walls of the container. The front wall 40 is also provided with first, second and third recessed areas 46, 48 and 50. These recessed areas further serve to stiffen the front wall 40 of the container.

A fourth recessed area 52 is provided adjacent the bottom edge of the container. In the preferred embodiment, the recessed area 52 is located in the lower right hand corner of the front wall. A spout 54 projects from the front wall in the recessed area at an acute angle thereto. The spout 54 defines a first aperture 56 through which fuel can flow by gravity feed when the container is filled with fuel and is oriented in an upright position.

Figure 3:
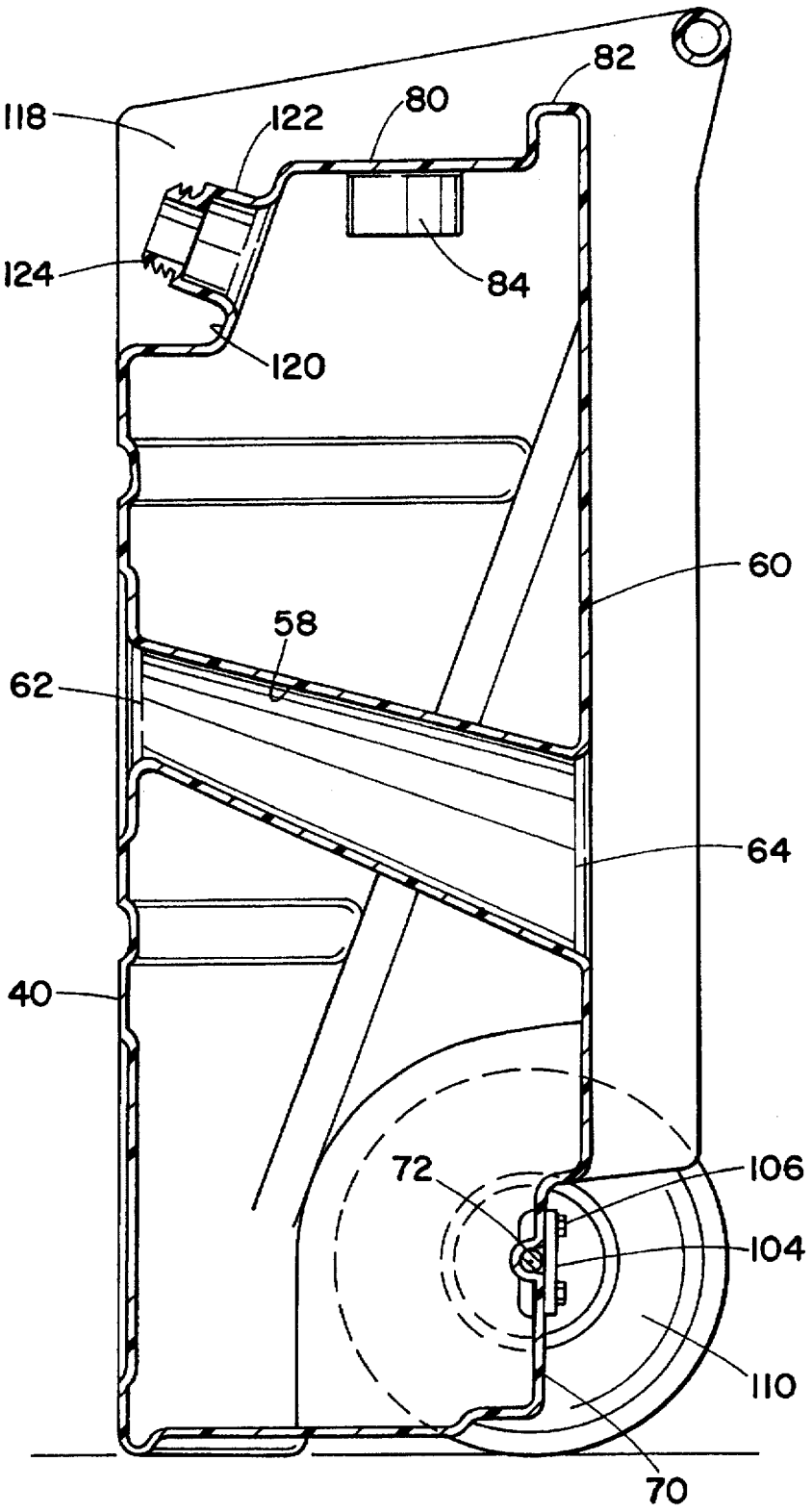
FIG. 3 is a cross-sectional view of the tank of FIG. 2 along line 3—3.

With reference now to FIG. 3, a through chamber 58 extends through the container from the front wall 40 thereof to a rear wall 60 thereof. The through chamber is defined by a front opening 62 and a rear opening 64. It is evident that the through chamber is somewhat tapered or conical in shape so that the front opening 62 has a smaller diameter than does the rear opening 64. However, it should be appreciated that variations on the shape of such a chamber can be envisioned by those of average skill in the art. For example, the shape of the chamber openings could be other than circular if particularly desired. Also, the dimensions of the front and rear openings could be reversed so that the front opening could be larger than the rear opening, if desired.

The integral chamber 58 increases the strength of the tank. The chamber 58 is advantageous for restricting expansion of the tank due to vapor pressure build up in the fuel stored in the tank during the summertime when filled tank is exposed to sunlight.

Figure 5:
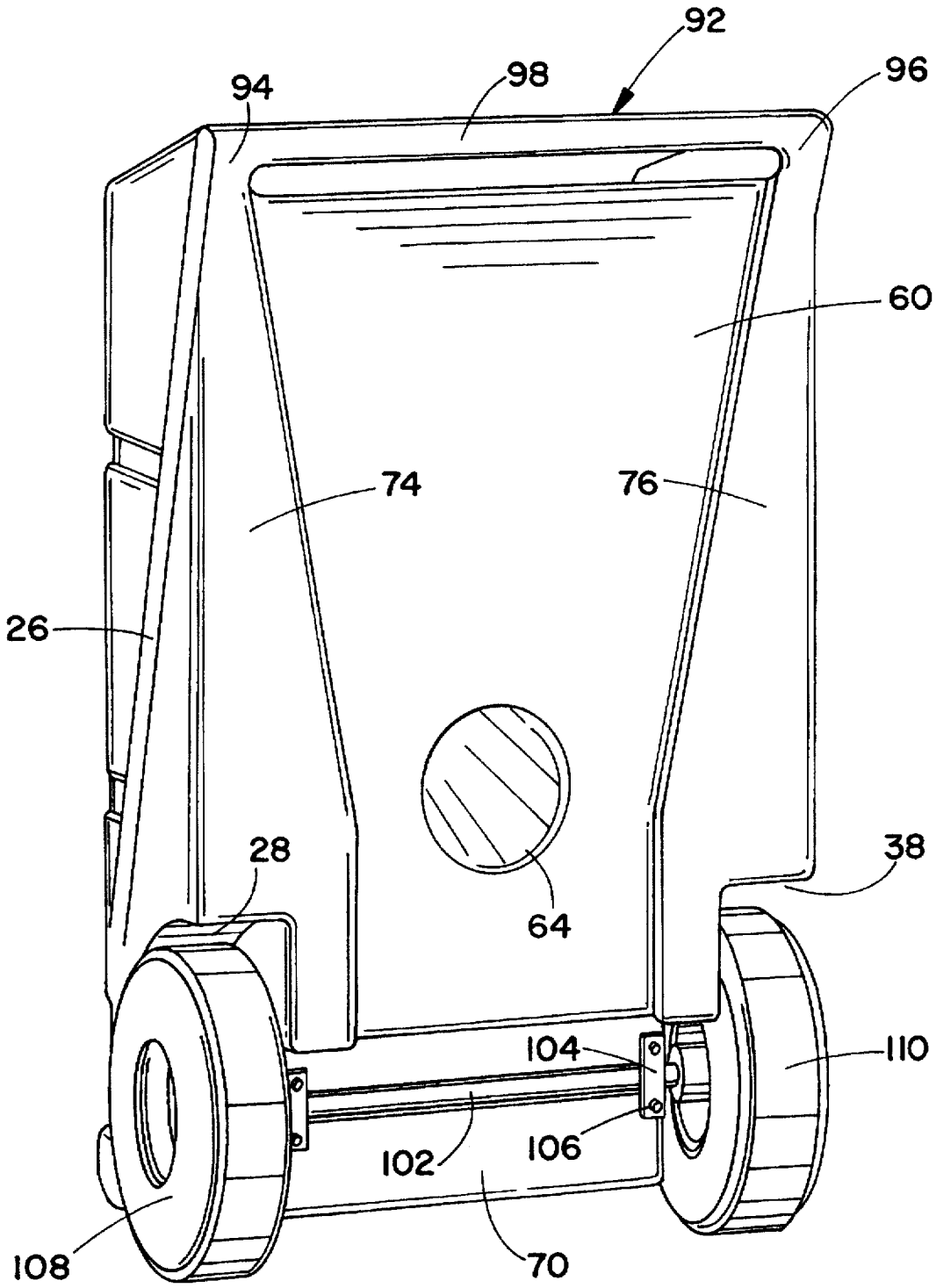
FIG. 5 is a rear perspective view of the tank of FIG. 1.

With continued reference to FIG. 3, the container rear wall 60 includes a recessed lower section 70 in which a semi-circular or U-shaped depression 72 extends transversely from side to side. As best shown in FIG. 5, the rear wall 60 also includes a pair of longitudinally extending raised sides or rails 74 and 76 which are hollow and which further serve to strengthen the container. The rails 74 and 76 also enable the container to be more easily slid when it is full and is oriented horizontally, such as when it is located in the bed of a pickup truck.

With reference again to FIG. 4, the container also includes a top wall 80 having a raised transversely extending rear section 82. A threaded bung 84 in the top wall 80 defines a second aperture 86 which provides a second path for the outflow of fuel. With reference again to FIG. 2, the top wall 80 also includes a pair of raised sides 88 and 90 that lead to a handle 92. The rear section 82 and raised sides 88 and 90 serve to stiffen the top wall 80. The handle is particularly defined by the cooperation of the pair of raised sides 88 and 90 of the top wall 80 as well as the rails 74 and 76 of the back wall 60. These cooperate to define a pair of ears 94 and 96. Extending between the ears is a crossbar 98 which is preferably of one piece therewith. As is evident, the crossbar 98 is hollow so that fuel can even be stored therein.

Figure 6:
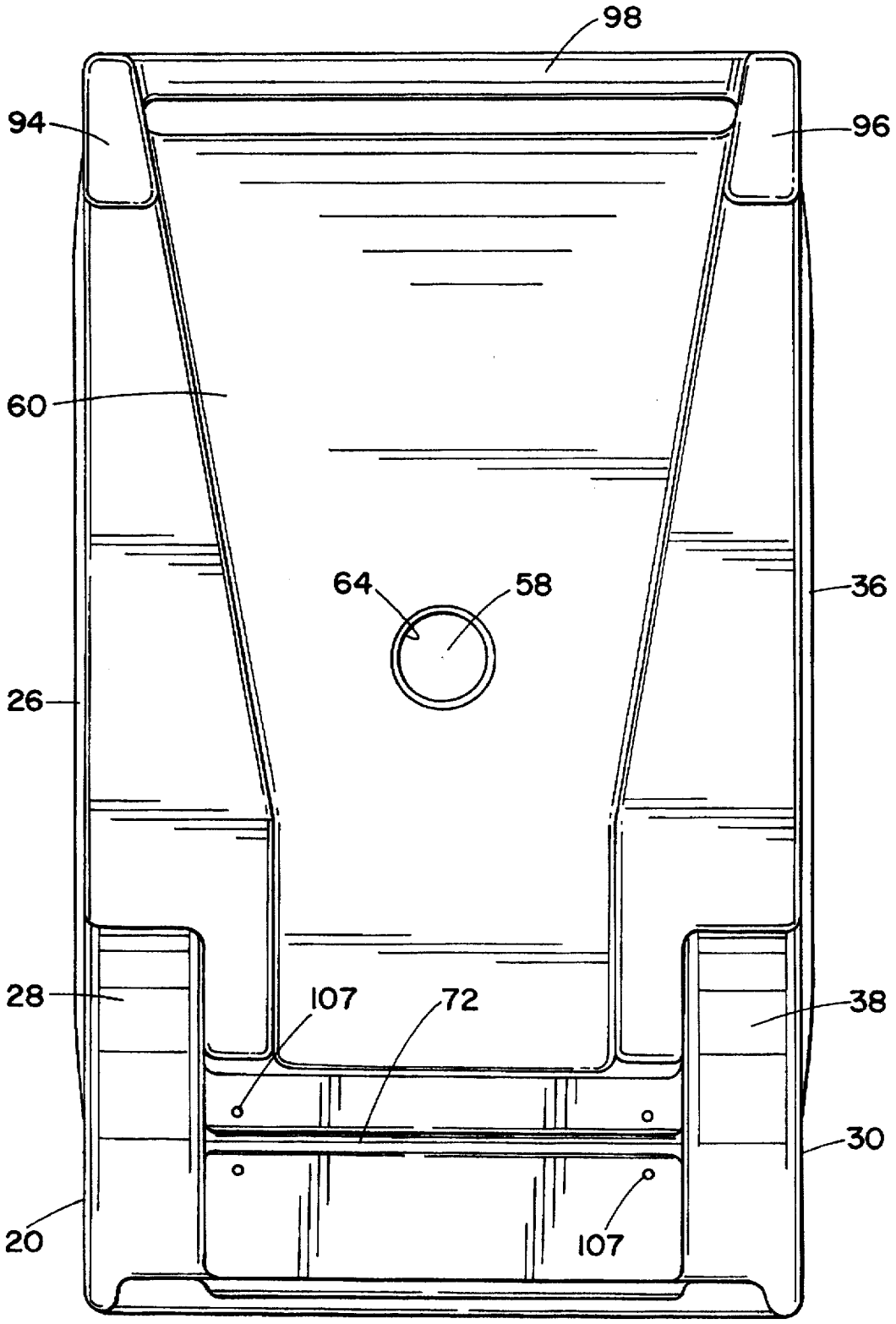
FIG. 6 is a rear elevational view of the tank of FIG. 1 with certain components removed for ease of comprehension.

Positioned in the semi-circular depression 72 on the rear wall recessed lower section 70 is a longitudinally extending axle 102. The axle is held in the depression by a pair of straps 104, each of which is secured by suitable conventional fasteners 106 to the container rear wall 60 at apertures 107 (FIG. 6). As is evident from FIG. 6, the depression 72 has a pair of reduced diameter portions adjacent the apertures 107. These portions insure that the axle 102 does not rattle in the depression 72 when the container is being moved. Located on the two ends of the axle are a pair of tires 108 and 110. Preferably, the tires are pneumatic and have a wide footprint to provide ease of maneuverability on different surfaces and terrain. As mentioned, the first and second side walls each have a recessed area 28 and 38 in which a respective one of the tires 108 and 110 is accommodated. Recessing the container side walls enables the wheels to not extend out beyond the side walls of the tank so that they become obstructions to the movement of the tank. This position of the wheels also prevents the wheels from scratching or marring adjacent objects while the tank is being moved.

The pneumatic tires 108 and 110 are advantageous in that they absorb shock. In addition, the recessed axle housing provided by the semi-circular depression 72 on the rear wall 60 enables the entire container 10 to absorb shocks delivered to the axle 102 by the tires 108 and 110 when the tank is dropped, such as when it is unloaded from, e.g., the bed of a flatbed truck. With the recessing of the axle housing, the forces on the axle will not be borne by the fasteners 106, which secure the straps 104 to the back wall 60, but rather by the container itself. This strengthens the tank and enables it to better withstand rough handling.

Defined between the front wall 40 and the top wall 80 is a recessed area 118 which comprises an angled wall 120, as shown in FIG. 3. Extending away from the angled wall 120 is a fill spout 122 which is provided on its outer surface with threads 124 so as to accommodate a suitable threaded conventional fill cap 126 (FIG. 1). If desired, the angled wall 120 can be oriented approximately at a 60° angle in relation to the top wall 80 and approximately at a 30° angle in relation to the front wall 40. The fill spout 122 can, if desired, be oriented approximately normal to the angled wall 120.

With reference again to FIG. 1, the fuel tank preferably further includes a shut-off valve 130 mounted on the spout 54. This valve may be, e.g. a manually actuated ball valve which may be made of a brass material. The weakest point of the container 10 is the joint between the valve 130 and the spout 54 because of the dissimilar materials employed. Recessing the area in which the spout 54 is positioned enables this joint to be somewhat protected thereby reducing the possibility that the valve 130 will be sheared away from the spout 54 during movement of the container 10.

A first end of a fill hose 132 is secured to the valve 130. Secured to the second end of the hose is a fuel nozzle 134. Preferably the fuel nozzle is spring loaded to shut off the flow of fuel. In order to dispense fuel, an operator squeezes a trigger 135 of the nozzle. This action assures that by opening the valve 130, the fuel held in the container does not become free-flowing, creating a potentially dangerous situation. Preferably, the nozzle 134 is manufactured out of nylon, which is gasoline resistant. Making the nozzle out of a plastic material also prevents any potential risk of explosion due to static electricity. It should be recognized that if the nozzle 134 were made of a metal, static electricity could be generated if the nozzle were not grounded. The use of a plastic nozzle eliminates this problem. Similarly, because the container 10 is made of a plastic material, it also does not need to be grounded.

The reason for providing the manual shut-off valve 130 in addition to the nozzle 134 is safety. During periods of non-use, it is recommended that the shut-off valve 130 be closed as this assures that accidental discharge of gasoline or other fuel will not occur if someone depresses the handle 135 of the nozzle 134.

If desired, the hose 132 can be approximately 10 feet in length for accessibility in a variety of refueling situations. In order to keep the hose out of the way while moving the tank, the hose can be secured on a strap 136, which may be made of plastic, looped around the fill spout 122. Access to the hose is provided by a snap buckle 138 on the strap.

The container 10 is so constructed as to have two stable positions. First, a stable upright position and second, a stable horizontal position. In the upright position, the base of the container is formed by the U-shaped rib 14 located on the bottom wall 12 and the two tires 108, 110 as is evident from FIGS. 1 and 4. In the horizontal position, the container rests on the two tires 108, 110 and on the two ears 94, 96 as well as the crossbar 98 as can best be seen in FIG. 5.

Figure 7:
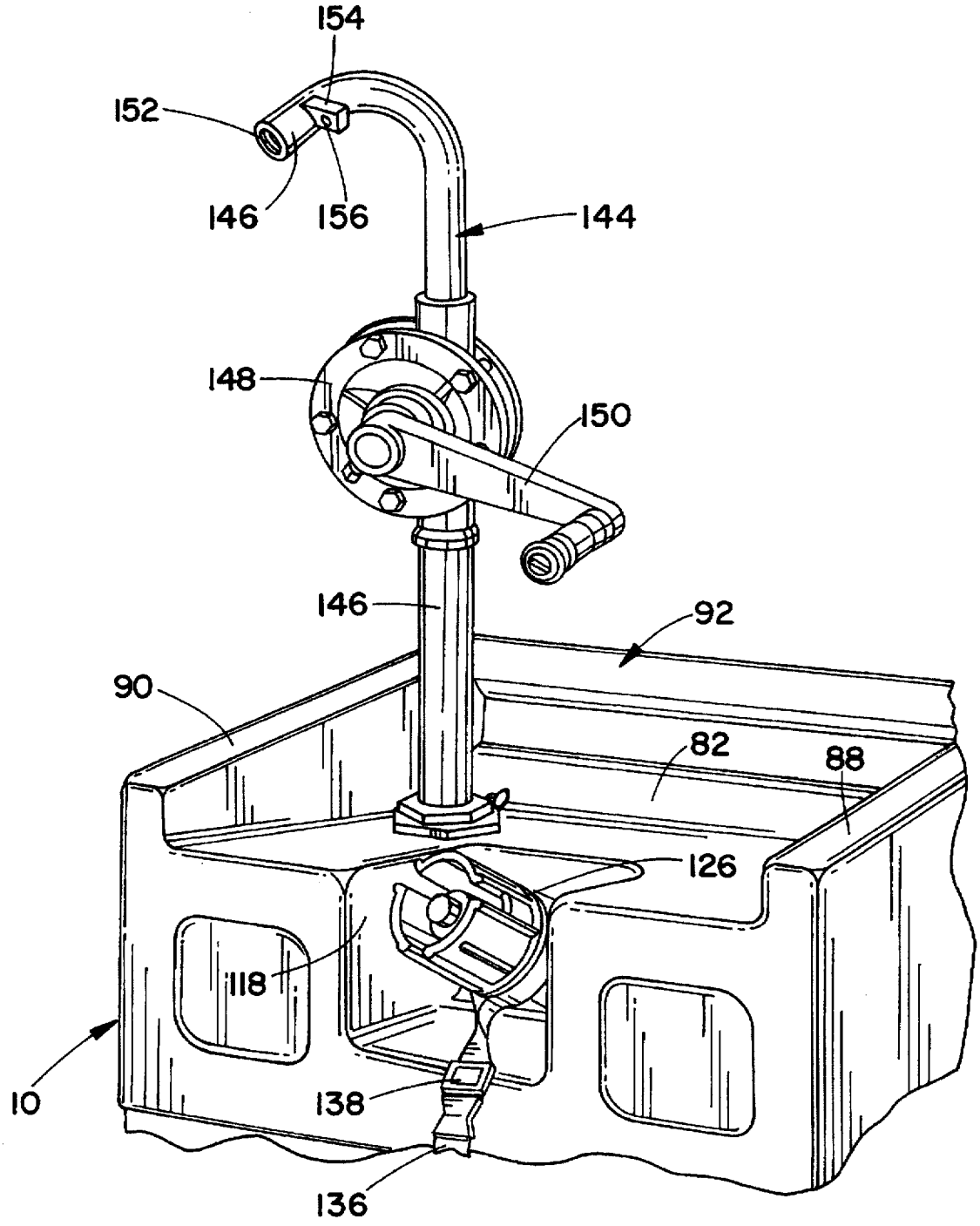
FIG. 7 is an enlarged perspective view of a portion of the tank of FIG. 1 with a manually powered pump attached, thereto.

The top opening, or bung 84, is preferably sealed by a conventional cap 142 (FIG. 1) when not in use. With reference now also to FIG. 7, if desired, a rotary hand pump assembly 144 can be secured in the bung to allow a transfer of fuel or another fluid to an elevated tank or container. The pump assembly 144 includes a metallic tube 146 and a pump member 148 actuated by a crank 150. An outlet end of the tube 146 is provided with internal threads 152 that enable a suitable fitting such as, e.g. a ¾ inch NPT type fitting, to be secured to the tube. Secured to the tube 146 adjacent the outlet at the free end thereof by, e.g., brazing or welding, is a tab 154. Extending through the tab is an aperture 156 which can accommodate, e.g. a machine screw or the like, for the purpose of securing one end of a grounding wire to the tube 146 and grounding the metallic rotary hand pump assembly when employing such assembly for pumping fuel out of the container 10. Should the need occur to remove fuel from a vehicle fuel tank or the like, a hose from the tank which needs to be emptied can be secured to the free end of the tube 146. Reversing the pumping motion on the crank 150 of the pump 148 will pump the fuel into the container 10.

Preferably the container 10 is manufactured of a suitable conventional plastic material such as marine grade crosslinked polyethylene for durability and strength. Plastic is also advantageous from the standpoint that it won't rust, dent or mar the deck of a boat. The container can be manufactured by rotational molding as is known in the art.

The tank A has a twenty-five gallon (94 liter) capacity and a dry weight of forty pounds (18.14 kg). The capacity of the tank A compares favorably with the 20 to 30 gallon (76 to 114 liter) size of fuel tanks on pleasure boats.

Preferably the container is 21 inches (53.3 cm.) wide, 37.5 inches (95.3 cm.) high and 10.8 inches (27.4 cm) deep. The wall thickness of the container can be approximately 0.120 inches (3 mm.).

Figure 8:
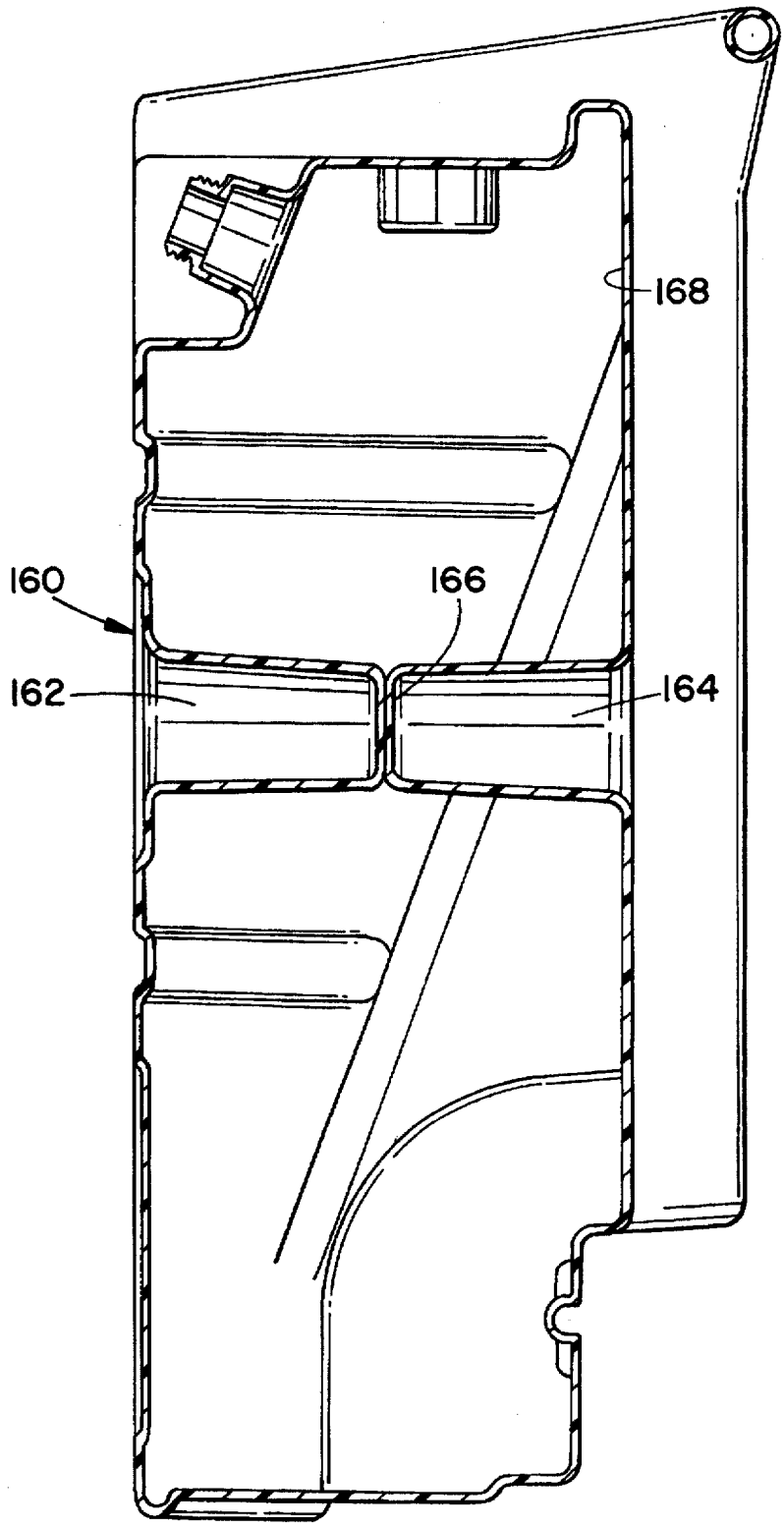
FIG. 8 is a cross-sectional view of a second type of reinforcing chamber according to the present invention; and, FIG. 9 is a cross-sectional view of a third type of reinforcing chamber according to the present invention.

With reference now to FIG. 8, another type of reinforcing chamber for a tank 160 is there illustrated. This chamber includes a first cavity 162 extending inwardly from a front wall and a second cavity 164 extending inwardly from a rear wall. The two cavities adjoin and are separated from each other by a central dividing wall 166 formed of the material of the container. It should be appreciated that a hollow interior 168 of the container 160 is separated only at this area of the cross-section thereof by the reinforcing chamber whereas sections of the interior above and below the wall 166 can communicate with each other on either side of the chamber since the chamber is located substantially in the middle of the container. This may be more easily understood from a comparison of FIGS. 3 and 4 which illustrate cross-sections through the container illustrated in front view in FIG. 2. In this embodiment of the invention, the molding of the container is done in such a fashion as to leave the web or wall 166 in the body of the container 160 during the process of manufacture thereof.

Figure 9:
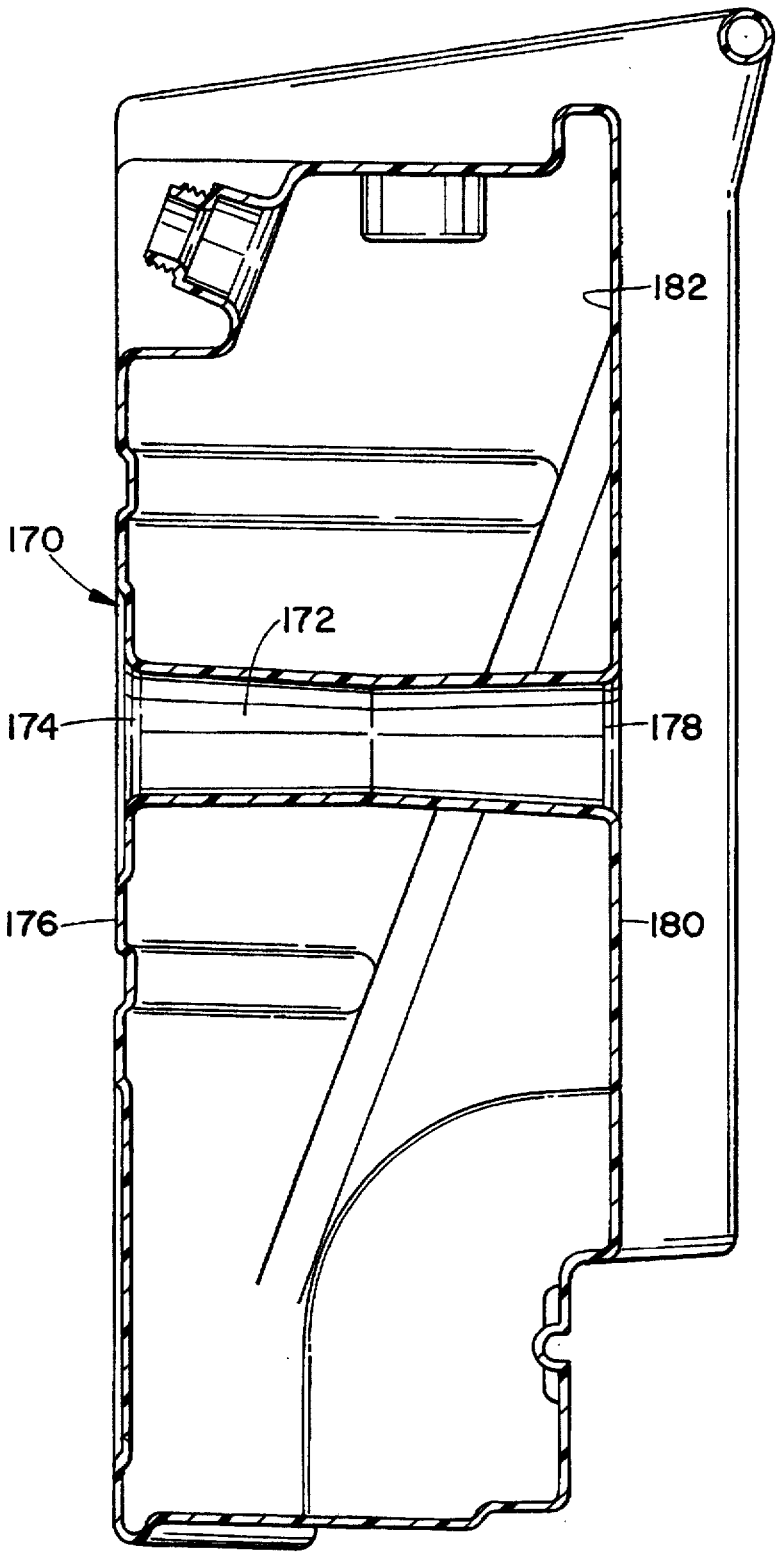

With reference now to FIG. 9, yet another type of a reinforcing chamber for a container 170 is there illustrated. A chamber 172 extends through the container such that a front opening 174 of the chamber is located in a front wall 176 of the container and a rear opening 178 of the chamber is located in a rear wall 180 of the container. Unlike the tapered chamber 58 illustrated, e.g. in FIG. 3, the chamber 172 has a substantially constant diameter. A hollow interior 182 of the container 170 extends around the chamber 172 such that sections of the interior above and below the chamber 172 can communicate with each other.

The invention has been described with reference to a preferred embodiment. Obviously, modifications and alterations will occur to others upon a reading and understanding of the preceding detailed description. It is intended that the invention be construed as including all such modifications and alterations insofar as they come within the scope of the appended claims, or the equivalents thereof.

What is claimed is:

1. A wheeled fuel tank comprising:

a container having a hollow interior enclosed by a bottom wall, two side walls, a front wall, a back wall and a top wall;

a fill spout disposed on said container for filling said container with a fuel;

a first opening in said container for allowing an outflow of the fuel;

a reinforcing chamber extending through said container from said front wall to said back wall for restricting an expansion of said container due to fuel vapor pressure and increasing its strength;

an axle rotatably mounted on said back wall; and, a pair of wheels, a respective one mounted on a respective end of said axle for enabling said container to be wheeled to a desired location.

2. The fuel tank of claim 1 further comprising a handle integrally mounted on said container, said handle comprising:

first and second rearwardly extending ears defined by said rear wall and a respective one of said side walls; and, a crossbar extending between said ears and being of one piece therewith.

3. The fuel tank of claim 1 wherein said side and back walls define a pair of recesses, each recess accommodating a respective one of said wheels thereby enabling said container to be no wider at said wheels than at the remainder of said container.

4. The fuel tank of claim 1 further comprising at least one recessed strip portion extending transversely across said front wall and at least a portion of said side walls, said at least one recessed strip strengthening said container and providing a positioning means for associated hold down straps for said container.

5. The fuel tank of claim 1 further comprising a second opening in said container for allowing an outflow of fuel, said second opening being spaced from said first opening and comprising a bunghole having a threaded periphery.

6. The fuel tank of claim 5 further comprising a pump which can be selectively threaded into said bunghole.

7. The fuel tank of claim 1 further comprising:

a valve secured to a stem defining said first opening in said container;

a hose having a first end secured to said valve; and, a nozzle secured to a second end of said hose.

8. The fuel tank of claim 1 wherein said fill spout is located on an intermediate wall defined between said front wall and said top wall and further comprising a fill cap closing said fill spout.

9. The fuel tank of claim 1 further comprising a plurality of indented sections defined on at least one of said walls for strengthening said container.

10. A fuel tank made of a thermoplastic material for corrosion resistance and weight reduction, comprising:

an elongated substantially rectangular container comprising:

a bottom wall, two side walls, each of one piece with said bottom wall and extending from a respective side thereof, a front wall of one piece with said bottom wall and said side walls, a back wall of one piece with said bottom wall and said side walls, a top wall of one piece with said front and back walls and said two side walls, and a hollow fuel holding interior defined by said walls;

a fill, spout disposed on one of said top wall and said front wall;

a first opening located on one of said walls for allowing an outflow of fuel;

a reenforcing chamber extending through said container from said front wall to said back wall for restricting an expansion of said container due to fuel vapor pressure and increasing its strength;

a first means for supporting said container in a substantially vertical upright position; and, a second means for supporting said container in a substantially horizontal reclining position.

11. The fuel tank of claim 1 further comprising a handle integrally mounted on said container, said handle comprising:

first and second rearwardly extending ears defined by said rear wall and a respective one of said side walls; and, a crossbar extending between said ears and being of one piece therewith, wherein said handle comprises an element of said second means for supporting said container.

12. The fuel tank of claim 10 further comprising:

an axle rotatably mounted on said back wall; and, a pair of wheels, a respective one mounted on a respective end of said axle, wherein said pair of wheels comprise an element of said first means for supporting said container and an element of said second means for supporting said container.

13. The fuel tank of claim 12 wherein said side and back walls define a pair of recesses, each recess accommodating a respective one of said wheels thereby enabling said container to be no wider at said wheels than at the remainder of said container.

14. The fuel tank of claim 12 wherein said bottom wall includes a rib section which comprises an element of said first means for supporting said container.

15. A wheeled fuel tank comprising:

a container having a hollow interior defined by a bottom wall, two side walls, a front wall, a back wall and a top wall;

a fill spout extending from said front wall and being of one piece therewith;

a threaded bung hole extending away from said top wall and of one piece therewith;

a handle integrally mounted on said container, said handle comprising:

first and second upwardly and rearwardly extending ears defined by said rear wall and a respective one of said side walls, and a crossbar extending between said ears and being of one piece therewith;

a first rail extending away from said back wall and terminating at said first ear;

a second rail extending away from said back wall, in a spaced relationship to said first rail, and terminating at said second ear, wherein said first and second rails enable said container to be slid when said container is in a horizontal orientation;

an axle rotatably mounted on said back wall;

a pair of wheels, a respective one mounted on a respective end of said axle; and, a rib extending downwardly from said bottom wall, wherein a bottom tangential point of said wheels is in horizontal alignment with a bottom edge of said rib to allow said container to rest in a stable vertical orientation.

16. The fuel tank of claim 15 further comprising at least one indentation extending transversely across said front wall and at least a portion of said side walls, said at least one indentation strengthening said container and proving a positioning means for hold down straps for said container.

17. The fuel tank of claim 15 further comprising a gravity dispensing opening in said container for allowing an outflow of fuel, said gravity dispensing opening being spaced from said bung hole.

18. The fuel tank of claim 15 further comprising a reinforcing chamber extending substantially through said container for restricting an expansion of said container due to fuel vapor pressure and increasing its strength, wherein said container is of one piece and is made of a thermoplastic material for corrosion resistance.

19. The fuel tank of claim 15 wherein said dispensing spout extends out of an indented section of said front wall.

20. The fuel tank of claim 15 wherein said rib is substantially U-shaped so that it extends under said front wall and said side walls.

21. A wheeled fuel tank comprising:

a container having a hollow interior enclosed by a bottom wall, two side walls, a front wall, a back wall and a top wall;

a fill spout disposed on said container front wall for filling said container with fuel;

a first opening in said container for allowing an outflow of the fuel said first opening being located on said top wall and comprising a threaded bung hole;

a pump which can be selectively secured in said bung hole via said threading thereof;

an axle rotatably mounted on said container; and, a pair of wheels, a respective one mounted on a respective end of said axle for enabling said container to be wheeled to a desired location.

22. The fuel tank of claim 21 further comprising:

a second opening in said container for allowing an outflow of fuel, said second opening being spaced from said first opening.

23. The fuel tank of claim 21 further comprising a valve secured in said first opening in said container.

24. The fuel tank of claim 21 wherein said side and back walls define a pair of recesses, each recess accommodating a respective one of said wheels thereby enabling said container to be no wider at said wheels than at the remainder of said container.

25. The fuel tank of claim 21 wherein said fill spout is located adjacent an intersection of said front wall and said top wall and further comprising a fill cap closing said fill spout.

26. A fuel tank made of a thermoplastic material for corrosion resistance and weight reduction, comprising:

an elongated substantially rectangular container comprising:

a bottom wall, two side walls, each of one piece with said bottom wall and extending from a respective side thereof, a front wall of one piece with said bottom wall and said side walls, a back wall of one piece with said bottom wall and said side walls, a top wall of one piece with said front and back walls and said two side walls, and a hollow fuel holding interior defined by said walls;

a recessed area located at an intersection of said front wall and said top wall;

a fill spout disposed in said recessed area for filling said container interior with a fuel;

a first opening located on one of said container walls for allowing an outflow of the fuel;

a first means for supporting said container in a substantially vertical upright position; and, a second means for supporting said container in a substantially horizontal reclining position.

27. The fuel tank of claim 26 further comprising:

an axle rotatably mounted on said back wall; and, a pair of wheels, a respective one mounted on a respective end of said axle, wherein said pair of wheels comprise an element of said first means for supporting said container and an element of said second means for supporting said container.

28. The fuel tank of claim 26 wherein said side and back walls define a pair of recesses, each recess accommodating a respective one of said wheels thereby enabling said container to be no wider at said wheels than at the remainder of said container.

29. The fuel tank of claim 26 wherein said first opening comprises a bunghole having a threaded periphery and further comprising a pump which can be selectively threaded into said bunghole.

30. The fuel tank of claim 26 further comprising:

a second opening located on one of said container walls for allowing an outflow of the fuel, said second opening being spaced from said first opening; and, a valve secured to a stem defining said second opening in said container.

* * * * *